US005188470A

United States Patent [19]

Matsubara et al.

[11] Patent Number: 5,188,470

[45] Date of Patent: Feb. 23, 1993

[54] PRINTER CONTROL SYSTEM FOR A SHEET CUTTER

[75] Inventors: Motoki Matsubara, Kishiwada; Setsuo Sasabe, Osaka; Takayasu Hongo, Kobe; Kenichi Fujii, Osaka, all of Japan

[73] Assignee: Kanzaki Paper Manufacturing Co., Ltd., Tokyo, Japan

[21] Appl. No.: 752,027

[22] Filed: Aug. 29, 1991

[30] Foreign Application Priority Data

Aug. 31, 1990 [JP] Japan ..... 2-230841
Sep. 18, 1990 [JP] Japan ..... 2-249861

[51] Int. Cl.[5] ..... B41J 11/70; B41J 11/42
[52] U.S. Cl. ..... 400/621; 400/583
[58] Field of Search ..... 400/582, 583, 593, 621, 400/630, 551, 577; 101/226, 227

[56] References Cited

U.S. PATENT DOCUMENTS 4,639,739 1/1987 Tsutsumi ..... 400/593
4,925,325 5/1990 Niikawa ..... 400/582
4,957,381 9/1990 Sakai et al. ..... 400/621
4,968,165 11/1990 Karube et al. ..... 400/593

FOREIGN PATENT DOCUMENTS 173675 7/1988 Japan ..... 400/621

*Primary Examiner*—Edgar S. Burr
*Assistant Examiner*—Stephen R. Funk
*Attorney, Agent, or Firm*—Morgan & Finnegan

[57] ABSTRACT

A printer having a cutter 6 including: program storage 2 for storing printer control programs such as a data edition program, a printing control program and a cutter control program, where the program storage has a random access memory for storing the predetermined length of each of plural sheet divisions arranged on the web to be cut out, the total length of a printing zone in each of the sheet divisions and a blank distance between adjacent two printing zones of the sheet divisions; and a central processing unit 1 for operating the cutter 6 to cut the sheet division according to the data and the programs read out from the program storage, to cut out a sheet in the predetermined length with a printed zone where the central processing unit 1 precalculates the continued travel length L of the web from a travel reference position, where any predetermined point in the sheet or a subsequent sheet division is placed in a predetermined relative position to the printer after printing of the printed zone, to a travel end position where a cross line of the web to be a rear edge of the sheet is aligned with a cutting line of the cutter 6.

3 Claims, 4 Drawing Sheets

PRINTER CONTROL SYSTEM FOR A SHEET CUTTER

DETAILED DESCRIPTION OF THE INVENTION

1. Field of Application

The present invention relates to a printer such as a label printer having a sheet cutter, particularly with a cut control system which can cut the sheet at a desired position.

2. Prior Art

Conventionally, the following systems have been used as the systems for cutting a continuous sheet or web (e.g., a recording sheet) in a printer.

a) a system in which the cutting device can be moved along the direction of sheet movement and it is precedingly set corresponding to the cutting position on the sheet (e.g., a movable type cutting device), b) a system in which a mark is precedingly provided at the position to be cut on the sheet and the mark is detected and the sheet is cut there (e.g., a fixed cutter type cutting device), c) a system in which the sheet is cut to a length defined by the length of the form according to the mechanical structure (e.g., a fixed cutter type cutting device).

Therefore, a conventional cut control system can cut a sheet only at a predetermined position on the continuous sheet or web and it was difficult to cut the sheet at a desired position for each time.

Particularly, in the case where the fixed cutter type printer in the above systems (b) and (c) is used as a label printer, the printer performs a series of steps including printing the necessary content on each zone of aligned divisions (for each finished label) of the sheet material such as postal address form and label form having predetermined form and size, then cutting the sheet into sheet divisions and adhering them automatically on the subject goods. However, the series of steps of printing-cutting-adhesion is required to be handled rapidly and in large amount.

On the other hand, conventionally in the printer performing printing-cutting operation, when the printing for each zone is completed, it is a common practice that the sheet is simply sent forward to the cutter position and cut and then sent back to the printing position and thus considerable time is wasted for sheet cutting inevitably.

An object of the present invention is to provide a cut control system which can cut the web to a desired size.

Another object of the present invention is to provide a printer having a cutter which can efficiently perform the total operation of printing and cutting, and more particularly shifting the objective web between their operating positions.

SUMMARY OF THE INVENTION

According to the present invention, a printer having the following constitution is provided: In the printer including a stepping motor for feeding a web, a printing head and a cutter placed at a predetermined distance from the printing head downstream of the feeding of the web, the cutter being adapted to cut a sheet in a predetermined length after printed from the web when stopping the feeding of the web and stopping the operation of the printing head, the printer includes a control program storage means for storing the printer control programs such as a data edition program, a printing control program and a cutter control program and the like, the means having a random access memory for storing the length of the sheet division to be cut, the whole length of the printing zone in each sheet division and the distance between printing zones in the adjacent sheet divisions and the like; and a central processing unit for executing cutting operation of sheet divisions by the cutter according to the data and the programs read out of the storage means, to cut out a sheet in the predetermined length with a printed zone therein, the central processing unit establishing by precalculating a continued travel length, L of the web from a travel reference position where any predetermined point in the sheet or a subsequent sheet division is placed in a predetermined relative position to the printer after printing of the printed zone to a travel end position where a cross line of the web to be a rear edge of the sheet is aligned with a cutting line of the cutter.

One of the above programmed operations comprises beginning printing on the subsequent sheet division after printing of a printed sheet division at a position in the blank distance from the printing zone of the printed sheet division, completing the continued travel of the web for the length, L and interrupting the printing on the susequent sheet division by the printing head, operating the cutter and then restarting the feeding of the web to return the printing head to printing the subsequent sheet division.

Another one of the above programmed operations comprises, continuing the feeding of the web when the printing head is stopped after printing of each sheet division to complete the feeding of the web for the continued travel length, L, operating the cutter, sending back the web by the length L, and thereafter restarting the feeding of the web for processing the subsequent sheet division.

Still another one of the above programmed operations comprises, continuing the feeding of the web when the printing head is stopped after printing of each sheet division to complete the feeding of the web by the length L, operating the cutter and thereafter restoring the feeding of the web for processing the subsequent sheet division.

BRIEF DESCRIPTION OF THE DRAWINGS

FIG. 3B is a continuation of the Level III operations shown in FIG. 3A FIGS. 4, 5 and 6 are drawings illustrating the operations of web feeding for printing and cutting according to the present invention.

DESCRIPTION OF THE PREFERRED EMBODIMENTS

Figure 1:
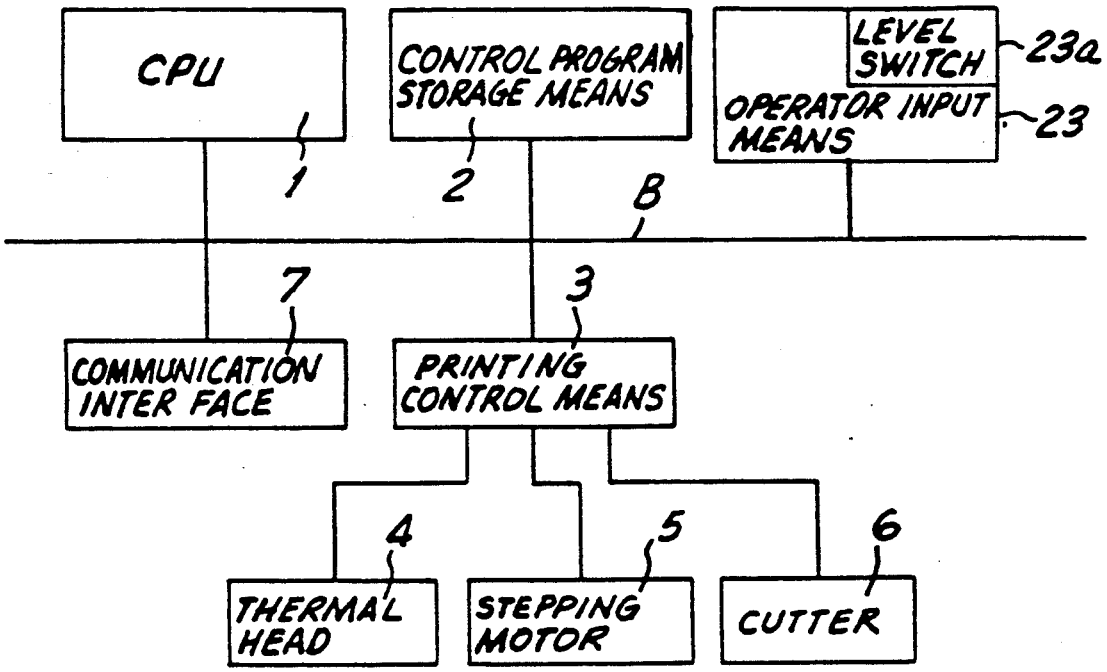
FIG. 1 is a block diagram showing a system constitution of a printer having a cutter in one embodiment according to the present invention.
Figure 2:
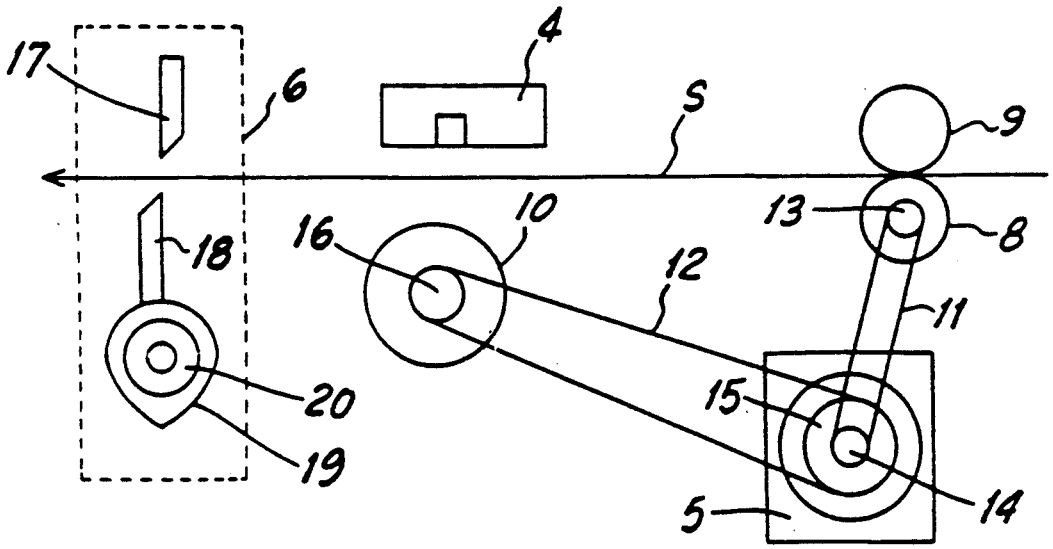
FIG. 2 is a drawing schematically showing a concrete constitution of the mechanical system of the equipment according to FIG. 1.

It is noted that FIG. 1 is a block diagram showing the system constitution of a printer having a cutter in one embodiment according to the invention, and FIG. 2 is a drawing schematically showing its mechanical constitution. Referring now to FIG. 1, B designates a system bus, 1 a CPU, 2 a control program storage means, 3 a printing control means, 4 a thermal head for printing, 5 a stepping motor for driving the recording sheet or web, 6 a cutter for cutting the sheet at the defined position, 7 a communication interface for information transfer, and 23 designates input means for the operator such as a key board including a level switch 23*a* for switching cutting operation levels.

Control program storage means 2 stores fundamental programs for the printer such as a data edition program and a printing control program and also a program for controlling the cutter operation in relation to printing operation and sheet sending operation and the like. Based on these programs, the thermal head 4, the stepping motor 5 and the cutter 6 are controlled by the CPU 1 and the program operation for the printer is executed.

The level switch 23*a* comprises a part of the key board or a manual switch and a proper control program related to the cutter operation and the web feeding operation is read out of the storage means 2 by the signal selectively generated from the switch. The selection signal can be input from a host computer through a communication interface 7 with no use of the level switch 23*a*.

Figure 3A:
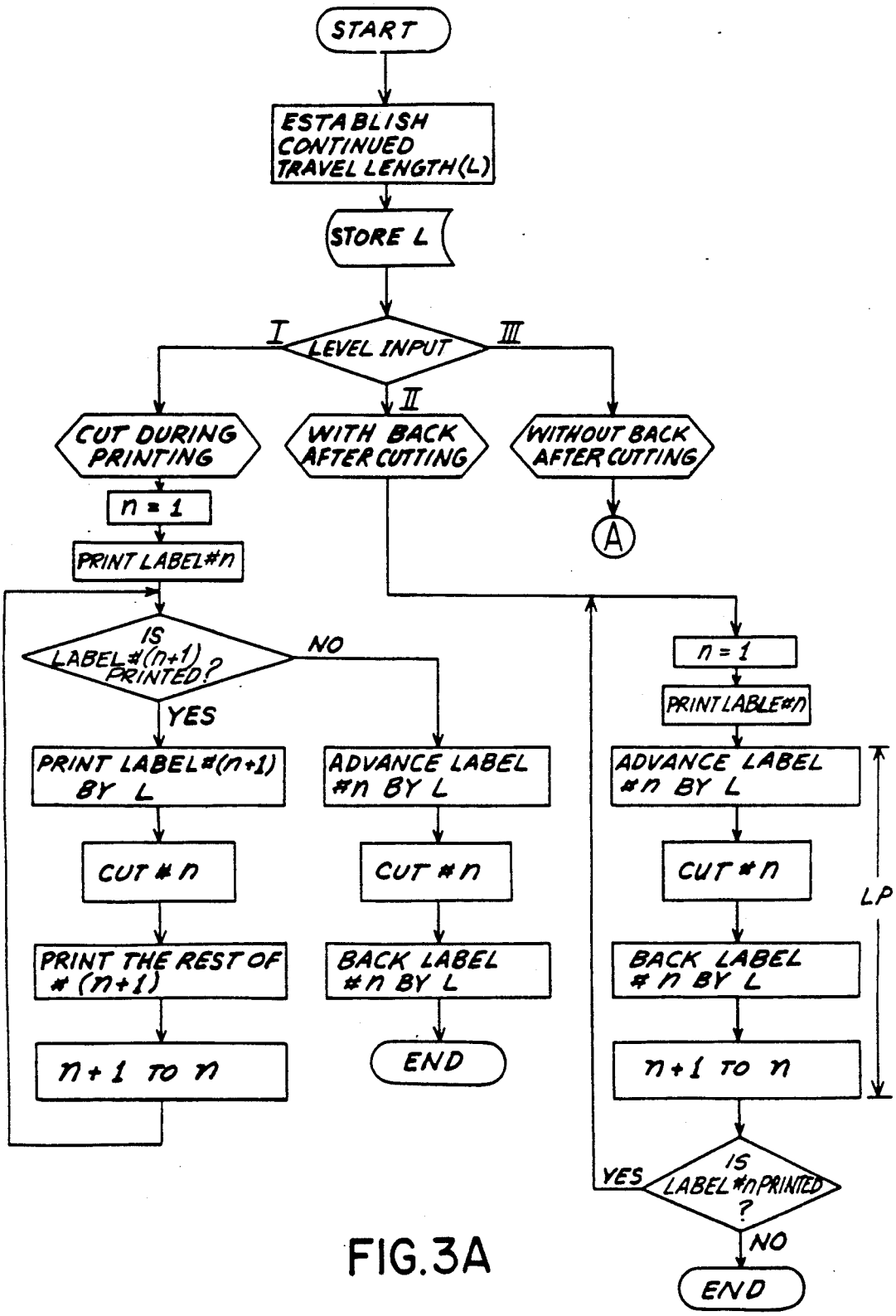
FIGS. 3A and 3B are flow diagrams illustrating the different web feeding operations for printing and cutting according to the present invention, where
Figure 3B:
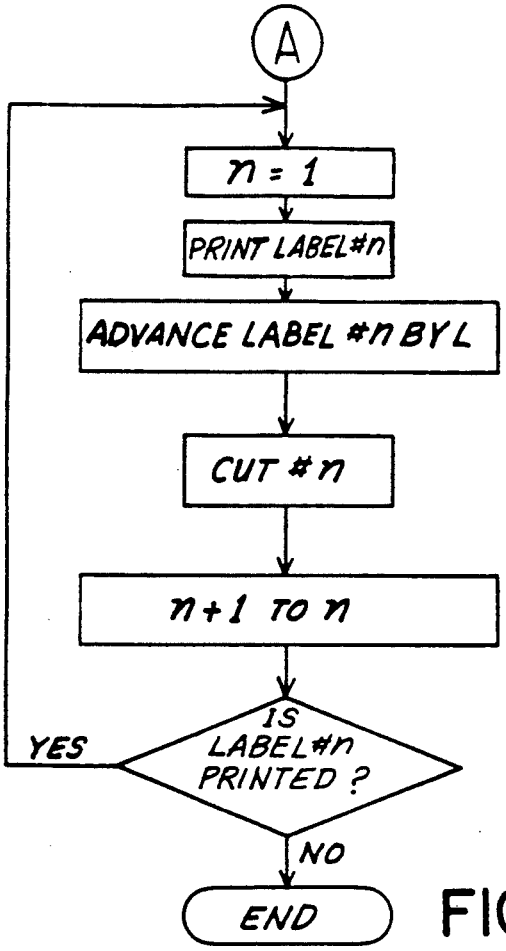

The type and the content of the program operations are shown in FIG. 3 and they will be described later.

Referring to FIG. 2, the mechanical constitution of equipment according to the system constitution of FIG. 1 is explained. S designates a web for the preparation of printing sheet divisions such as a paper, a plastic film and a tuck paper. 8 designates a web feeding roller, 9 designates an impression roller, 10 designates a platen roll sending the sheet S under impression to the printing head 4 during printing, 11 designates a web driving belt, 12 designates a platen driving belt and 13, 14, 15 and 16 designate belt pullies.

The cutter 6 is placed downstream of the web feeding from the printing head at a sufficient distance and comprises for example a fixed blade 17, an up-and-down movable blade 18, an eccentric cam 19 for moving the movable blade 18 up-and-down and a cutter motor 20. The movable blade 18 can be of rotary type ( rotary blade) in place of up-and-down moving type.

Now, the operation of the present invention will be described referring to the program constitution in FIG. 3 and also referring to the operational illustrations in FIGS. 4, 5 and 6.

Figure 4:
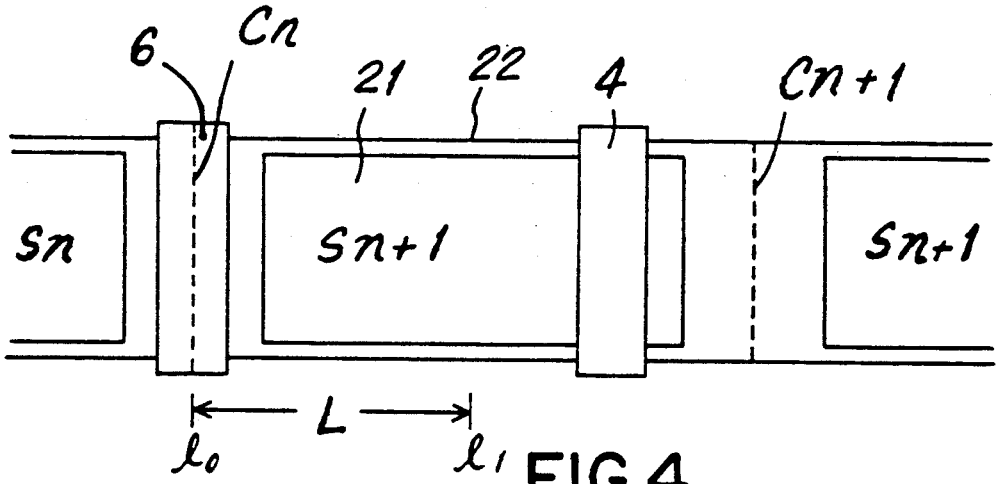

In the case where each sheet divisions are tuck papers, they are constituted by laminating a surface substrate 21 coated with an adhesive on a release paper web 22 as shown in FIG. 4. The width and the length in the feeding direction of the surface substrate and the distance between the adjacent surface substrates are different depending on the type of the tuck paper and the object of application.

Hence, the information including the length of one sheet of the tuck paper, the distance between them, the web movement, or travel length L, until the position to be cut on the web reaches the cutter after an appropriate time from the printing of n-th sheet and the printing zone of the tuck paper are precedingly input to the RAM memory of the program storage means 2 before printing and cutting. As the web travel length L, is stored in the rewritable RAM, the sheet division can be cut to optional size from the same web by changing the web travel length L, for each predetermined number of the sheets.

A program of an operation as a printer (FIGS. 3A and 3B) is started. In the embodiment, three levels of operation (I, II and III) are selectively executed. The printing operation and the web operation for each level are controlled by the cpu 1 and the printing control means 3.

The operations for each level will be illustrated in detail as follows.

FIG. 4 is an operational illustration for the operation level I. When the first sheet division is printed completely, the sheet is sent to the position where the second sheet division is started to be printed and the printing of the second sheet division is started. When the printing of the second sheet division proceeds and for example the rear edge of the first sheet division reaches a predetermined position $l_1$, on the equipment (hereinafter referred to as "reference position"), the CPU 1 confirms it by some procedure and commands feeding of the web by length L. When the web travels by L, printing is temporarily stopped and the rear edge of the first sheet division reached to the position $l_0$ matched to the blade of the cutter 6. After cutting of the first sheet, the remaining printing on the second sheet division is executed.

Thereafter, the second and third sheet divisions are processed in the same manner and generally the relationships between the n-th and (n+1)-th sheet division as well as (n+1)-th and (n+2)-th sheet division are processed.

Figure 5:
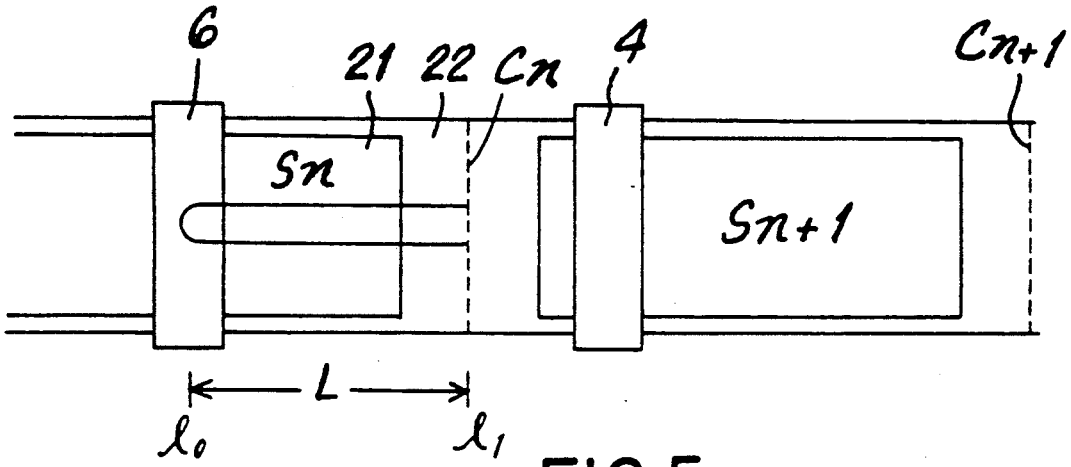

FIG. 5 is an operational illustration of the operation level II. After the first sheet division is printed completely, when the web reaches "reference position", the web is pushed forward by the web travel length L and the cutter 6 is driven at this position to cut the sheet. After the sheet is cut, the web is pulled back by the web travel length L to restore the original reference position. Then, the second sheet division is started to be printed. Thereafter, the sheet divisions up to n-th (or full number) one are processed in the same manner.

Figure 6:
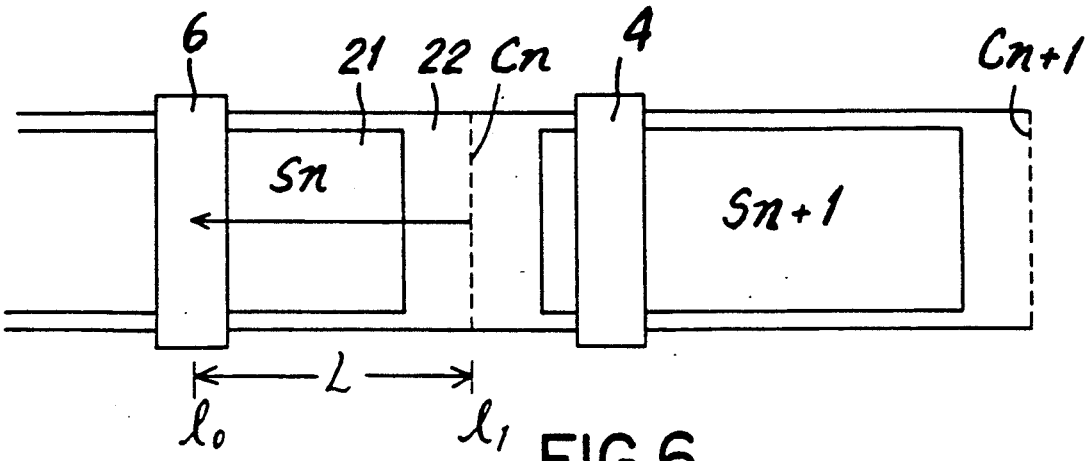

FIG. 6 is an operational illustration of the operation level III. After the first sheet division is printed completely, when the web reaches "reference position", the web is pushed forward by the web travel length L and the cutter 6 is driven at this position to cut the sheet. Immediately after the sheet is cut, the second sheet division is started forward to be printed. Thereafter, the sheet divisions up to n-th (or full number) one are processed in the same manner.

The operation can be selected from the three levels mentioned above according to the requirement. It is also possible that the level switch 23*a* is not provided in the printer but it is constituted to execute only one operation level as a monofunctional device. The reference point on the web for determining the start point of the travel distance L can be set optionally, for example, at the rear edge of the surface substrate 21. However, the position of the web to be cut can be also determined at the rear end of the printed zone or by the generation of the printing signal itself. The features and the effects of each programmed printing operation levels are as follows.

When the level I is selected, web feeding for the printing can be utilized in common with the feeding for cutting and no sending back of the sheet is unnecessary after the cutting.

Hence, the period or time consumption required for the total operation for printing and cutting can be remarkably decreased.

The operation of level II shall send the web forward and backward in the length L. However, it causes no deterioration of printed quality caused by interrupting printing of subsequent sheet division in the level I. Also in the level II, the length of L can be set at $L=0$ and $L<0$ in addition to a predetermined positive value according to the relationship to the length of the printing zone in the sheet division.

Figure 7:
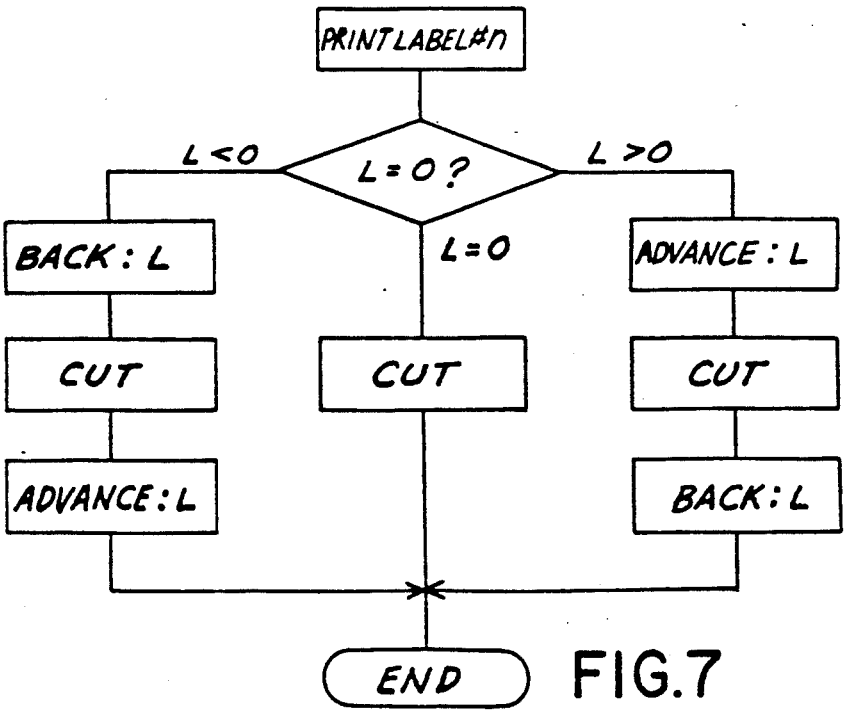
FIG. 7 is a flow diagram showing a part of the program in which part of the flow diagram of FIG. 3 is branched.

FIG. 7 shows LP procedure section in the level II in the flow diagram of FIG. 3 changed to a section which can be branched.

According to the procedure section, printing and cutting can be executed efficiently.

In the case $L>0$, the mode is for pushing the web by L from the reference position. On the contrary, when $L=0$ the web is cut at the same time, while when $L<0$ the web is pulled back by $|L|$ and stopped and cut and then pushed forward by $|L|$ to restore the standard position when $L<0$.

Level III operation is the same as Level I in that the sheet does not return by the distance L after cutting the web, and although print quality is good, care should be taken so that the area of the blank portion relative to the area of the printed zone in a sheet division is increased more than that of the other two levels.

What we claimed is:

1. A printer including a stepping motor for feeding a web, a printing head for printing out on a surface provided by the web, and a cutter placed at a distance downstream of the web fed from the printing head, the cutter being adapted to cut out a preceding one of continuous sheet divisions defined on the web each having a predetermined length after printing the preceding one division when stopping the feeding of the web and stopping operation of the printing head, said printer comprising:

storage means for storing a data edition program, a printing control program and a cutter control program, said storage means having a random access memory for storing said predetermined length of the sheet division arranged on the web to be cut out, the total length of a printing zone for each sheet division and the length of a blank area between adjacent printing zones of the sheet divisions;

a central processing unit including means for executing a cutting operation of the cutter for the sheet division according to the data and the programs read out from said storage means, to cut out the sheet division in the predetermined length with the printed zone, wherein said central processing unit precalculates a travel length L of the web from a travel reference position, where any predetermined point in the sheet or a subsequent sheet division is placed in a predetermined relative position to the printer after printing of said printed zone, to a travel end position where a rear edge of the sheet division is aligned with a cutting line of the cutter;

said central processing unit further includes selection means for selectively executing any one of three programmed printing operations, wherein the first programmed printing operation comprises:

(a) printing a first sheet completely by said printing head and then moving said first sheet until a second sheet is aligned under said printing head;

(b) moving said first sheet while said second sheet is printing until the rear edge of said first sheet reaches a predetermined position 1, which is a distance L from said cutter, wherein said central processing unit activates the web, feeding said first sheet the distance L while said second sheet is printing;

(c) completing feeding of said first sheet the distance L and interrupting the printing of said second sheet, cutting said first sheet under the cutter; and (d) resuming printing of said second sheet after said cutting of the first sheet;

wherein the second programmed printing operation comprises:

(a) printing a first sheet completely by said printing head;

(b) moving said first printed sheet until the rear edge of said first sheet reaches a predetermined position 1, which is a distance L from said cutter, wherein said central processing unit activates the web, feeding said first sheet the distance L;

(c) completing feeding of said first sheet the distance L, cutting said first sheet under the cutter; and (d) restoring the web to its original position, a distance L from said cutter, and (e) beginning printing of a second sheet after said cutting of the first sheet; and wherein the third programmed printing operation comprises:

(a) printing a first sheet completely by said printing head;

(b) moving said first printed sheet until the rear edge of said first sheet reaches a predetermined position 1, which is a distance L from said cutter, wherein said central processing unit activates the web, feeding said first sheet the distance L;

(c) completing feeding of said first sheet the distance L, cutting said first sheet under the cutter; and (d) beginning printing of a second sheet after said cutting of the first sheet; and level switching means for manually selecting one of said programmed operations.

2. A printer including a stepping motor for feeding a web, a printing head for printing out on a surface provided by the web, and a cutter placed at a distance downstream of the web fed from the printing head, the cutter being adapted to cut out a preceding one of continuous sheet divisions defined on the web each having a predetermined length after printing the preceding one division when stopping the feeding of the web and stopping operation of the printing head, said printer comprising:

storage means for storing a data edition program, a printing control program and a cutter control program, said storage means having a random access memory for storing the predetermined length of a sheet division arranged on the web to be cut out, the total length of a printing zone for each sheet division and the length of a blank area between adjacent printing zones of the sheet divisions;

a central processing unit including means for executing a cutting operation of the cutter for the sheet division according to the data and the programs read out from said storage means, to cut out the sheet division in the predetermined length with the printed zone, wherein said central processing unit precalculates a travel length L of the web from a travel reference position, where any predetermined point in the sheet or a subsequent sheet division is placed in a predetermined relative position to the printer after printing of said printed zone, to a travel end position where a rear edge of the sheet is aligned with a cutting line of the cutter, said central processing unit further includes selection means for selectively executing any one of three programmed printing operations, wherein the first programmed printing operation comprises:

(a) printing a first sheet completely by said printing head and then moving said first sheet until a second sheet is aligned under said printing head;

(b) moving said first sheet while said second sheet is printing until the rear edge of said first sheet reaches a predetermined position 1, which is a distance L from said cutter, wherein said central processing unit activates the web, feeding said first sheet the distance L while said second sheet is printing;

(c) completing feeding of said first sheet the distance L and interrupting the printing of said second sheet, cutting said first sheet under the cutter; and (d) resuming printing of said second sheet after said cutting of the first sheet;

wherein the second programmed printing operation comprises:

(a) printing a first sheet completely by said printing head;

(b) moving said first printed sheet until the rear edge of said first sheet reaches a predetermined position 1, which is a distance L from said cutter, wherein said central processing unit activates the web, feeding said first sheet the distance L;

(c) completing feeding of said first sheet the distance L, cutting said first sheet under the cutter; and (d) restoring the web to its original position, a distance L from said cutter, and (e) beginning printing of a second sheet after said cutting of the first sheet; and wherein the third programmed printing operation comprises:

(a) printing a first sheet completely by said printing head;

(b) moving said first printed sheet until the rear edge of said first sheet reaches a predetermined position 1, which is a distance L from said cutter, wherein said central processing unit activates the web, feeding said first sheet the distance L;

(c) completing feeding of said first sheet the distance L, cutting said first sheet under the cutter; and (d) beginning printing of a second sheet after said cutting of the first sheet; and input means for inputting a selection signal for one of said programmed printing operations from a host computer.

3. A printer in accordance with claim 2, wherein said input means further comprises a level switching means for manually selecting one of said programmed printing operations.

* * * * *